United States Patent [19]

Regester

[11] 3,984,148

[45] Oct. 5, 1976

[54] METHOD OF FORMING A TOOTH CLEANING DEVICE

[76] Inventor: Willard D. Regester, 2100 Sierra Ventura, Los Altos, Calif. 94022

[22] Filed: July 28, 1975

[21] Appl. No.: 599,733

Related U.S. Application Data

[60] Division of Ser. No. 330,811, July 13, 1972, Pat. No. 3,934,299, which is a continuation-in-part of Ser. No. 31,712, April 24, 1970, abandoned.

[52] U.S. Cl. ..... 300/21

[51] Int. Cl.[2] ..... A46D 1/00; A46B 5/04

[58] Field of Search..... 15/167 R, 104.92, 104.93, 15/104.94, 227, 244 C, 209 R, 210 R; 132/84, 91; 300/21

[56] References Cited

UNITED STATES PATENTS

| | | | |
|---|---|---|---|
| 1,569,854 | 1/1926 | Doerr | 15/227 |
| 2,265,274 | 12/1941 | Elliott | 15/104.94 |
| 3,094,729 | 6/1963 | Dalton | 300/21 X |
| 3,124,824 | 3/1964 | Lutz | 15/227 |
| 3,183,543 | 5/1965 | Worcester | 15/227 X |
| 3,229,690 | 1/1966 | Scholl | 15/244 C |
| 3,329,985 | 7/1967 | Glowacki, Jr. | 15/227 X |
| 3,675,264 | 7/1972 | Storandt | 15/227 X |

FOREIGN PATENTS OR APPLICATIONS

| | | | |
|---|---|---|---|
| 752,591 | 2/1967 | Canada | 15/227 |

*Primary Examiner*—Peter Feldman
*Attorney, Agent, or Firm*—Townsend and Townsend

[57] ABSTRACT

A method of forming a device adapted to be worn on the finger for cleaning the teeth, wherein the device has an outer surface provided with a fabric texture with the fabric being impregnated with a dentifrice material. The device is formed with a plurality of other identical devices by folding a sheet of fabric material, such as terry cloth, in half and then moving the folded sheet through a welding station at which a plurality of spaced welds are formed therein, with each pair of adjacent welds defining the side boundaries of a device. The sheet is cut at the welds to form the individual devices.

3 Claims, 12 Drawing Figures

FIG. 6
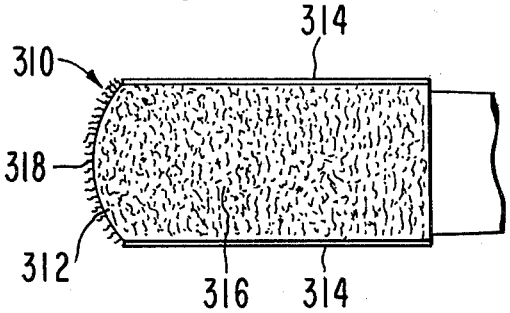
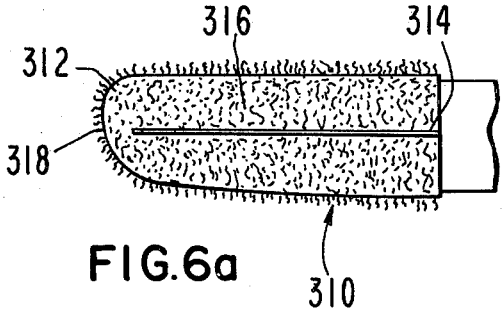
FIG. 6a
FIG. 7
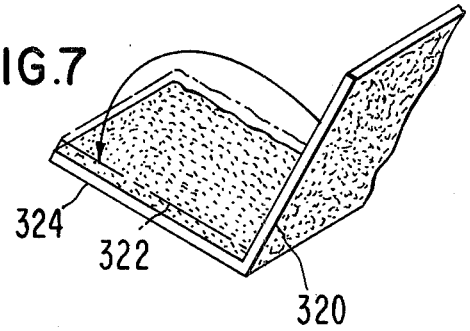
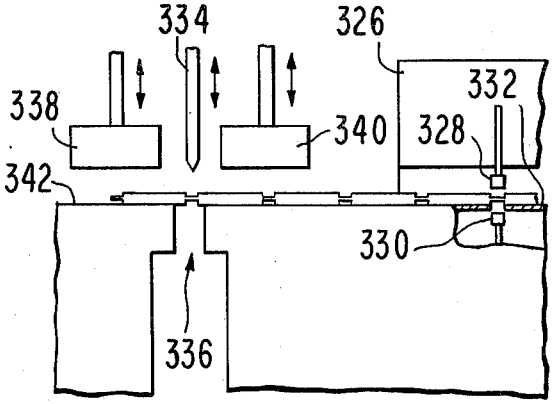
FIG. 8b
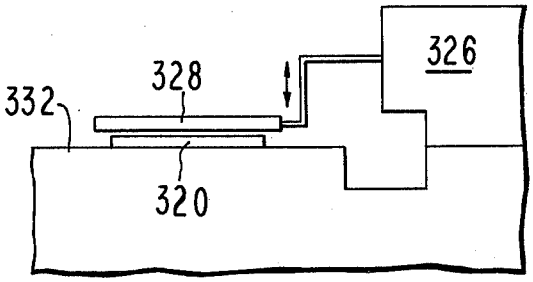
FIG. 8a
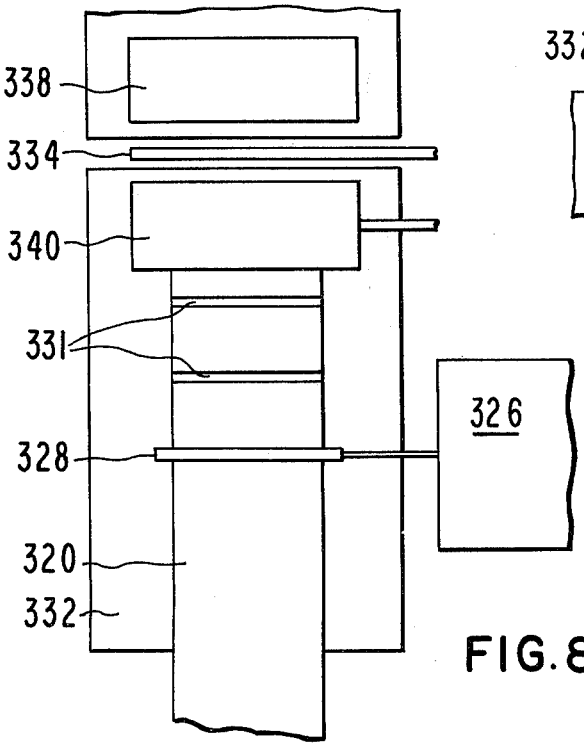
FIG. 8

METHOD OF FORMING A TOOTH CLEANING DEVICE

This is a division of application Ser. No. 330,811, filed July 13, 1972, now Pat. No. 3,934,299, which is a continuation-in-part of application Ser. No. 31,712, filed Apr. 24, 1970, entitled "TOOTH CLEANING DEVICE", now abandoned.

This invention relates to improvements in the manufacture of means for brushing the teeth and, more particularly, to a method of making a tooth cleaner of the type which can be worn on the finger.

The present invention is comprised of a method for forming a tubular body of terry cloth material having an open end allowing the same to be placed on a finger for use. The body has an outer, substantially continuous fabric surface throughout substantially its entire length and the fabric material is impregnated with a dentifrice material. The device is used by placing it on the finger and inserting the device in the mouth, then moving the device across the teeth much in the same way as brushing the teeth with a toothbrush. If the dentifrice is in a dry form, the device can first be moistened with water before use. After use, the device can be thrown away or can be reused, if desired. It can also be packaged in a flat condition in a sealed envelope. The construction of the device includes folding a sheet of terry cloth material in half, then welding the folded sheet at a plurality of spaced locations, following which the sheet is cut at the welds to form a number of individual devices. This method renders the device especially suitable for high-volume production at minimum cost. Thus, it is economical to throw the device away after a single use.

The primary object of this invention is to provide a method of forming a tooth cleaning device which can be worn on the finger and has a fabric texture on its outer surface throughout substantially its entire length wherein the method includes welding of a fabric sheet folded in half at a number of spaced locations and then cutting the sheet at such locations, whereby a number of devices are formed.

Figure 5:
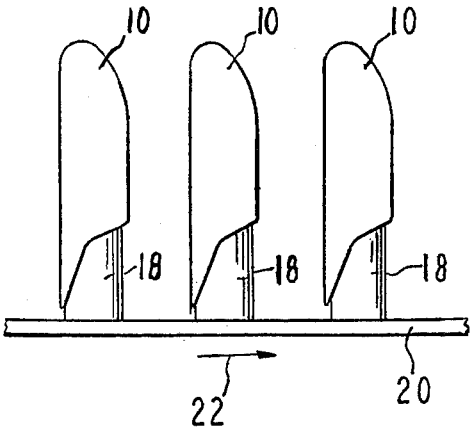
FIG. 5 is a fragmentary, side elevational view of a number of devices mounted on forms attached to a conveyor used in one method of manufacture of the device.
Figure 5A:
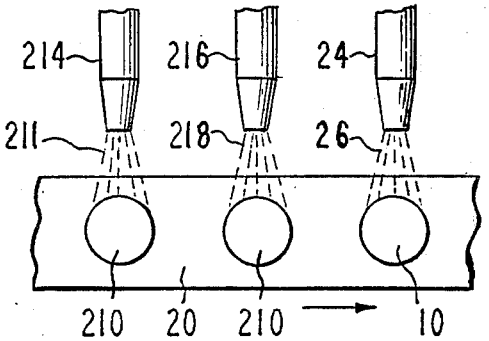

FIG. 5*a* is a schematic, top plan view of a production line for making the devices, showing one way of applying a material to each device;

FIG. 6 is a top plan view of another embodiment of the device;

FIG. 6*a* is a side elevational view of the device of FIG. 6;

FIG. 7 is an end elevational view of a flat sheet of terry cloth material, showing the way it is initially folded as one step in the method of making the device of FIGS. 6 and 6*a;* and FIGS. 8, 8*a* and 8*b* are top plan, end elevational and side elevational views, respectively, of the apparatus for carrying out the method of making the device of FIGS. 6 and 6*a*.

Figure 1:
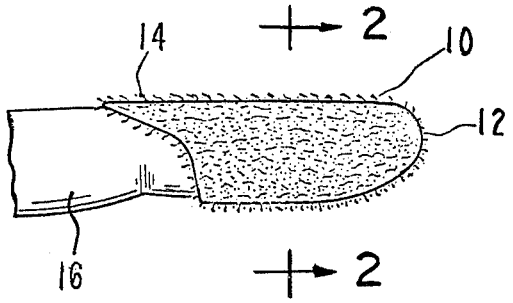
FIG. 1 is a side elevational view of one form of the device, showing the way it is mounted on a finger.
Figure 2:
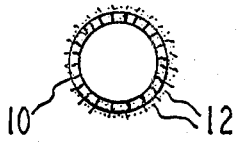
FIG. 2 is a cross-sectional view taken along line 2—2 of FIG. 1.

The first embodiment of the invention is illustrated in FIGS. 1 and 2 and includes a body 10 of terry cloth fabric material, the material having an outer, continuous fabric surface throughout substantially the entire length of body 10. Body 10 has a closure 12 at one end thereof and is open at the opposite end so that the device can be placed on a finger. A tab 14 is provided on body 10 adjacent to the open end to facilitate the placement of the device on the finger.

Since the material is of a fabric texture, it is absorbent and the device is impregnated with a dentifrice material, the latter being denoted by the dots in FIGS. 1 and 2. The dentifrice preferably is in a dry condition and, when the device is moistened, the dentifrice is ready to be used.

In use, device 10 is placed on a finger 16 so that the tip of the finger is disposed adjacent to closure 12. The device is then moistened and inserted in the mouth and the teeth are then scrubbed by the device with a motion substantially the same as that of a toothbrush used in the conventional manner. The fabric texture of the device allows foreign particles lodged in crevices of the teeth to be dislodged. Also, the fabric material can contact the gums without inflaming or otherwise irritating them.

After use, the device can be thrown away or stored until ready for use again. It can also be provided with dentifrice again, if desired, such as by spraying the dentifrice on the outer surface.

Body 10 is formed from a flat sheet of terry cloth material which is stitched at a pair of opposed edges so that it forms a tube having a closed end. The material is flexible so that it can be flattened to make it suitable for insertion into an envelope-type package. The product can then be marketed in substantially the same manner as pre-moistened, disposable towels now commercially available for travelers and others.

Figure 3:
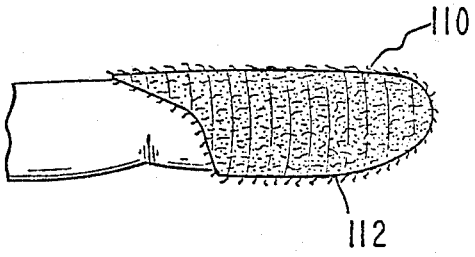
FIG. 3 is a view similar to FIG. 1 but showing another embodiment of the device.

Another embodiment of the device is illustrated in FIG. 3 and includes a body 110 of fabric material, such as terry cloth throughout substantially its entire length which is provided with elastic or stretchable bands 112 which permit the body to expand as it is placed on the finger. Body 110 is impregnated with a dentifrice material preferably in dry form and is substantially of the same construction as body 10 except for the bands. The device of FIG. 3 is used in the same way as described above with respect to body 10. Since body 110 can stretch, only one size need be made for all users. Even with bands 112, body 110 can be flattened to make it suitable for insertion into an envelope-type package.

Figure 4:
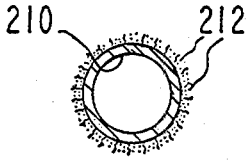
FIG. 4 is a cross-sectional view of a third embodiment of the device.

A third embodiment of the invention is illustrated in FIG. 4 and includes a tubular body 210 of latex or other stretchable material throughout substantially its entire length, and which is closed at one end and provided with bits or pieces of fabric 212 on its outer surface to provide an outer fabric texture therefor. The bits or pieces of fabric can be secured in any suitable manner, such as by an adhesive, to the outer surface of body 210. Also, the fabric pieces are impregnated with a dentifrice so that the device of FIG. 4 can be used in substantially the same manner as described above with respect to body 10. The stretchability of body 210 allows it to be placed on the finger regardless of the size of the finger; thus, a device of a single size can be used by different people.

In FIG. 5, a number of devices 10 can be mounted on upright forms 18 of a conveyor 20 movable in the direction of arrow 22 and used in the manufacture of device 10. The dentifrice material can be applied as shown in FIG. *5a*, wherein a number of devices on conveyor 20 move past one or more nozzle units for spraying material on the outer surfaces of the devices, such as when the latter are rotated about their axes in some suitable manner. The dentifrice penetrates the fabric material of each device 10 and dries so that, when the dentifrice is moistened, it can be used in the manner described above.

The device shown in FIG. 4 can be formed by using the spray techniques of FIGS. *5a* wherein body 210, after being formed, is first sprayed with an adhesive material 211 on a nozzle 214. Thereafter, a nozzle 216 sprays bits or pieces 218 of fabric material onto the adhesive-coated outer surface of body 210. The bits or pieces of fabric material adhere to the outer surface of body 210, following which, dentifrice can be sprayed onto the fabric material such as by the use of nozzle 24. The forms on which the devices are mounted can be caused to rotate in some suitable manner during the spraying action so that the entire outer surface of the devices can be covered. Other means of making the devices can be used, if desired.

Another form of the tooth-cleaning device of this invention is denoted by the numeral 310 and is shown in FIGS. 6 and *6a*. Device 310 has a body 312 of terry cloth material and is closed at one end and open at its opposite end. It is tubular in construction and has two side ribs 314 which are formed when the side margins of the opposed panel members 316 defining the body are welded together. The ribs, being of terry cloth material, are continuations of the outer surfaces of members 316 so that body 312 has a substantially continuous outer terry cloth fabric surface throughout substantially its entire length. Members 316 are integral with each other at location 318 forming the forward end of device 310.

Device 310 is impregnated with a dentifrice material and it can be packaged in a sealed envelope and stored until ready for use. The dentifrice material can be applied in any suitable manner, such as by spraying, dipping or the like and the dentifrice material can be in a dry form when the device is to be used. Thus, by dipping the device in water, the device is ready for use.

Device 310 is made by first providing an elongated sheet 320 of terry cloth material and folding the same in half so that the sheet has a section 322 overlapping section 324. A plurality of devices 310 can be formed by moving the folded sheet 320 through a welding station at which the two sheet sections are welded by a welder 326 having upper and lower welding elements 328 and 330 disposed above and below flat support surface 332 over which sheet 320 is incrementally moved by any suitable means. After each incremental movement of sheet 320, element 328 is lowered and the sheet is clamped between and welded by elements 328 and 330, whereupon upper and lower transverse grooves are formed in sheet 320 as shown in FIGS. 8 and *8b*. Each pair of adjacent grooves define the side boundaries of a respective device 310 and the grooves are formed because a relatively large pressure and a predetermined amount of energy is exerted on sections 322 and 324, causing them to be compressed where they are engaged by elements 328 and 330. In this way, a plurality of devices 310 are successively formed as sheet 320 moves incrementally over surface 332.

A welding apparatus suitable for this purpose is one of the types made and sold by Branson Sonic Power Company, Eagle Road, Danbury, Connecticut 06810, specifically the ultrasonic plastic welder, either the 400 Series or Model 4120. Such a machine can be adapted for welding the terry cloth material of sheet 320 wherein fibers of the side margins of panel members 316 are connected together to form a tight bond and thereby form the tube for each device 310.

FIG. *8b* illustrates a means for separating the end device 310 from sheet 320 wherein a reciprocal blade 334 is mounted above a space 336 adjacent to one end of surface 332. Similarly, a pair of reciprocal clamps 338 and 340 are mounted on opposite sides of blade 334 and are disposed to clamp sheet 320 to surface 332 and to another support surface 342 adjacent to space 336. The means (not shown) for reciprocating blade 334 and clamps 338 and 340 can be synchronized with the incremental movement of sheet 320 and with the action of welder 326, so that the clamps can hold the sheet against movement, following which the blade is lowered to sever the end device 320 cleanly without rupturing the side margin thereof. To this end, the blade severs the grooves aligned therewith midway between the sides of the grooves, thereby assuring that the corresponding rib 314 will be formed, yet the rib will form a substantial continuation of the outer surface of members 316 of each device 310. The device can then be directed into a receiving container and then the dentifrice can be applied thereto in any suitable manner. In the alternative, the dentifrice can be applied to sheet 320 before the individual devices 310 are formed by welding machine 326.

A dentifrice material suitable for use in carrying out the teaching of the present invention can be made by mixing the following ingredients which, for purposes of illustration, are listed by weight to make a mixture of approximately 133.5 fluid ounces:

| | |
|---|---|
| 190 proof ethyl alcohol | 119.500 oz. |
| toothpaste | 14.000 oz. |
| boric acid | 1.125 oz. |
| peppermint | .426 oz. |
| menthol | .270 oz. |
| saccharin | .135 oz. |
| U.S. certified green food color | .020 oz. |
| Total yield | 133.5 fluid oz. |

What is claimed is:

1. A method of forming a tooth cleaning device comprising: providing a sheet of terry cloth material, folding the sheet about its center line to form two sides therefor with the sides being overlapping; successively welding the two overlapping sheets together at spaced, transverse locations along the length of the sheet to form respective, open end tubular bodies; severing the individual bodies from each other; and impregnating the bodies with a dentifrice material.

2. The method as set forth in claim 1, wherein said bodies are formed successively as the sheet moves along a flat surface.

3. The method as set forth in claim 1, wherein the bodies are successively severed from the sheet after the bodies are formed as the sheet remains on the surface.

* * * * *